US006456155B2

(12) United States Patent
Takai

(10) Patent No.: US 6,456,155 B2
(45) Date of Patent: Sep. 24, 2002

(54) DIFFERENTIAL AMPLIFIER CIRCUIT WITH OFFSET CIRCUIT

(75) Inventor: Yasuhiro Takai, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/833,974

(22) Filed: Apr. 12, 2001

(30) Foreign Application Priority Data

Apr. 13, 2000 (JP) ..... 2000-112336

(51) Int. Cl.[7] ..... G05F 1/46
(52) U.S. Cl. ..... 327/541; 327/543; 323/315
(58) Field of Search ..... 327/563, 538, 327/540, 541, 543, 307, 309; 323/315, 316

(56) References Cited

U.S. PATENT DOCUMENTS 4,095,164 A * 6/1978 Ahmed ..... 323/226
4,185,211 A * 1/1980 Kucharewski ..... 327/73
4,574,202 A * 3/1986 Ogawa ..... 327/104
4,806,791 A * 2/1989 Mizuide ..... 327/66
5,212,458 A * 5/1993 Fitzpatrick et al. ..... 330/288
5,352,935 A * 10/1994 Yamamura et al. ..... 327/540
5,548,241 A * 8/1996 McClure ..... 327/538
5,642,034 A * 6/1997 Amano ..... 323/277
5,686,867 A * 11/1997 Sutardja et al. ..... 331/57
6,100,744 A * 8/2000 Yoon et al. ..... 327/589
6,160,450 A * 12/2000 Eschauzier et al. ..... 330/253
6,194,887 B1 * 2/2001 Tsukada ..... 323/315

FOREIGN PATENT DOCUMENTS

JP 62-98325 6/1987 ..... H03F/3/45

* cited by examiner

*Primary Examiner*—Timothy P. Callahan
*Assistant Examiner*—Terry L. Englund
(74) *Attorney, Agent, or Firm*—Hutchins, Wheeler & Dittmar

(57) ABSTRACT

A differential amplifier circuit includes a first transistor and a second transistor cooperatively forming a current mirror circuit, a third transistor connected in series to the first transistor and connected to an inverted input terminal through which a comparison voltage which is a predetermined constant voltage is input to the third transistor, a fourth transistor connected in series to the second transistor and connected to a non-inverted input terminal through which a feedback voltage which increases in proportion to an output voltage of the third transistor is input to the fourth transistor, a constant current source for supplying predetermined current to the first to fourth transistors, and an offset circuit connected in series to the third transistor, and has a predetermined input offset voltage provided between the inverted input terminal and the non-inverted input terminal.

9 Claims, 10 Drawing Sheets

DIFFERENTIAL AMPLIFIER CIRCUIT WITH OFFSET CIRCUIT

BACKGROUND OF THE INVENTION

1. Field of the Invention

This invention relates to a differential amplifier circuit suitable for use with an internal voltage generation circuit used in a semiconductor integrated circuit device to produce a predetermined internal power supply voltage.

2. Description of the Related Art

A semiconductor integrated circuit device such as a semiconductor memory device in recent years does not directly use external power supply voltage $V_{CC}$ supplied from the outside, but lowers or raises external power supply voltage $V_{CC}$ by means of an internal voltage generation circuit to produce a predetermined internal power supply voltage and supplies the produced internal power supply voltage to internal circuits to achieve reduction of power consumption and augmentation of the reliability of the device.

In order to increase the storage capacity, for example, a semiconductor memory device employs memory cells of a refined transistor size. Since this makes it impossible to apply a high voltage to transistors, a lowered voltage power supply circuit is provided in the inside of the semiconductor memory device and supplies lowered voltage $V_{INT}$ lower than the external power supply voltage to the transistors for the memory cells.

Meanwhile, raised voltage $V_P$ higher than external power supply voltage $V_{CC}$ is sometimes applied to a word line of a DRAM, a non-volatile memory or a like device in order to assure a desired performance. Further, a semiconductor substrate is sometimes biased to a negative voltage in order to assure a high charge retaining characteristic of a DRAM. In this manner, a semiconductor memory device internally has an internal voltage generation circuit for producing various internal power supply voltages.

FIG. 1 is a block diagram showing an example of configuration of an internal voltage generation circuit.

Referring to FIG. 1, the internal voltage generation circuit includes raised voltage power supply circuit 10 for producing raised voltage $V_P$, lowered voltage power supply circuit 20 for producing lowered voltage $V_{INT}$ , reference voltage generation circuit 30 for supplying predetermined reference voltage $V_{REF}$ to raised voltage power supply circuit 10 and lowered voltage power supply circuit 20, and comparison voltage generation circuit 40 for producing predetermined comparison voltage $V_R$ to be supplied to reference voltage generation circuit 30 in order to suppress reference voltage $V_{REF}$ from fluctuating because of a variation of the ambient temperature.

Raised voltage power supply circuit 10 includes comparator 11, ring oscillator 12 and charge pump 13 connected in series, and divides raised voltage $V_P$ output from charge pump 13 by means of resistors R1, R2 and feeds back divided voltage $V_{P2}$ to comparator 11.

Comparator 11 compares divided voltage $V_{P2}$ and reference voltage $V_{REF}$ with each other. If $V_{P2}<V_{REF}$, then comparator 11 outputs a High level as an enable signal, but if $V_{P2}>V_{REF}$, then comparator 11 outputs a Low level as the enable signal.

Ring oscillator 12 includes a clock oscillator circuit and supplies a clock signal to charge pump 13 when the enable signal supplied from comparator 11 has the High level, but stops oscillation of the clock signal when the enable signal has the Low level.

Charge pump 13 produces raised voltage $V_P$ by multiple voltage rectification of the clock signal supplied from ring oscillator 12. If raised voltage $V_P$ rises higher than a predetermined voltage, then oscillation of ring oscillator 12 stops, and consequently, raised voltage $V_P$ drops gradually. On the other hand, if raised voltage $V_P$ drops lower than the predetermined voltage, then oscillation of ring oscillator 12 is restarted, and consequently, raised voltage $V_P$ rises. Raised voltage $V_P$ is maintained constant in this manner. As seen in FIG. 1, raised voltage $V_P$ is supplied to internal circuits of the semiconductor integrated circuit device and supplied also to lowered voltage power supply circuit 20 and reference voltage generation circuit 30.

FIG. 2 is a circuit diagram showing an example of configuration of the lowered voltage power supply circuit shown in FIG. 1.

Referring to FIG. 2, lowered voltage power supply circuit 20 includes output transistor 21 formed from an N-channel MOSFET supplied with external power supply voltage $V_{CC}$ for supplying lowered voltage $V_{INT}$ to an internal circuit serving as a load, differential amplifier circuit 22 supplied with raised voltage $V_P$ for outputting a control voltage for controlling the gate voltage of output transistor 21, and phase compensation capacitor $C_P$ interposed between an output contact of output transistor 21 and the ground potential for preventing oscillation of lowered voltage power supply circuit 20.

Differential amplifier circuit 22 includes transistors Q11, Q12 formed from P-channel MOSFETs connected commonly at the gates thereof, transistors Q13, Q14 formed from N-channel MOSFETs connected in series to transistors Q11, Q12 and connected at the respective sources thereof, and constant current source 23 for supplying predetermined current to transistors Q11 to Q14. Transistors Q11, Q12 form a current mirror circuit by connection of the gate and the drain of transistor Q11 so that values of Current flowing between the source-drain of transistors Q11, Q12 may be equal to each other.

Reference voltage $V_{REF}$ supplied from reference voltage generation circuit 30 is input to the gate of transistor Q13 connected to non-inverted input terminal 24, and the drain voltage of transistor Q14 which is an output of differential amplifier circuit 22 is applied to the gate of output transistor 21. Output voltage $V_{INT}$ (lowered voltage) output from the drain of output transistor 21 is fed back to the gate of transistor Q14 connected to inverted input terminal 25 of differential amplifier circuit 22.

Differential amplifier circuit 22 amplifies a difference between input voltages applied to inverted input terminal 25 and non-inverted input terminal 24 and outputs the amplified input voltage difference from the drain of transistor Q14. Accordingly, lowered voltage power supply circuit 20 shown in FIG. 2 operates so that, when output voltage $V_{INT}$ is lower than reference voltage $V_{REF}$, the potential at node A of differential amplifier circuit 22 rises and source-gate voltage $V_{GS}$ of output transistor 21 increases, and consequently, output voltage $V_{INT}$ rises. On the other hand, when output voltage $V_{INT}$ is higher than reference voltage $V_{REF}$, the potential at node A of differential amplifier circuit 22 drops and source-gate voltage $V_{GS}$ of output transistor 21 decreases, and consequently, output voltage $V_{INT}$ is lowered by the load. In other words, differential amplifier circuit 22 is controlled so that output voltage $V_{INT}$ may become equal to reference voltage $V_{REF}$.

FIG. 3 is a circuit diagram showing an example of configuration of the reference voltage generation circuit shown in FIG. 1.

Referring to FIG. 3, reference voltage generation circuit 30 includes output transistor 31 supplied with external power supply voltage $V_{CC}$ for supplying reference voltage $V_{REF}$ to raised voltage power supply circuit 10 and lowered voltage power supply circuit 20 which serves as a load, differential amplifier circuit 32 supplied with raised voltage $V_P$ for outputting a control voltage for controlling the gate voltage of output transistor 31, and phase compensation capacitor $C_P$ interposed between an output contact of differential amplifier circuit 32 and the ground potential for preventing oscillation. Differential amplifier circuit 32 has a configuration similar to that of differential amplifier circuit 22 for the lowered voltage power supply circuit shown in FIG. 2.

Comparison voltage $V_R$ supplied from comparison voltage generation circuit 40 is input to non-inverted input terminal 33 of differential amplifier circuit 32. Reference voltage $V_{REF}$ output from differential amplifier circuit 32 through output transistor 31 is divided by trimming resistors R3, R4, and feedback voltage $V_{REF}'$ which increases in proportion to reference voltage $V_{REF}$ is fed back to inverted input terminal 34 of differential amplifier circuit 32.

Where raised voltage power supply circuit 10 has such a configuration as shown in FIG. 1, it utilizes reference voltage $V_{REF}$ output from reference voltage generation circuit 30 to produce raised voltage $V_P$, and reference voltage generation circuit 30 uses raised voltage $V_P$ output from raised voltage power supply circuit 10 to produce reference voltage $V_{REF}$. Therefore, even if external power supply voltage $V_{CC}$ is supplied, reference voltage $V_{REF}$ and raised voltage $V_P$ are not output. Accordingly, startup circuit 35 for starting up reference voltage generation circuit 30 when external power supply voltage $V_{CC}$ is turned on is connected to reference voltage generation circuit 30.

Startup circuit 35 includes output transistor 36 formed from a P-channel MOSFET supplied with external power supply voltage $V_{CC}$, and differential amplifier circuit 37 supplied with external power supply voltage $V_{CC}$ for outputting a control voltage for controlling the gate voltage of output transistor 36. Comparison voltage $V_R$ is input to inverted input terminal 38 of differential amplifier circuit 37, and reference voltage $V_{REF}$ divided by trimming resistors R3, R4 is fed back to non-inverted input terminal 39 of differential amplifier circuit 37.

Differential amplifier circuit 37 includes transistors Q31, Q32 formed from P-channel MOSFETs connected commonly at the gates thereof, transistors Q33, Q34 formed from N-channel MOSFETs connected in series to transistors Q31, Q32 and connected commonly at the sources thereof, and constant current source 50 to supplying predetermined current to transistors Q31 to Q34.

Transistors Q31, Q32 form a current mirror circuit by connection of the gate and the drain of transistor Q31 and operate so that the values of current flowing between the source-drain of transistors Q31, Q32 may be equal to each other. The gate of output transistor 36 is connected to the drain of transistor Q33.

Transistors (N-channel MOSFETs) Q33, Q34 connected to inverted input terminal 38 and non-inverted input terminal 39, respectively, are formed with transistor sizes different from each other, and differential amplifier circuit 37 operates so that the voltage fed back to non-inverted input terminal 39 may be a little lower (by approximately 0.1 V) than comparison voltage $V_R$ input to inverted input terminal 38.

In reference voltage generation circuit 30 having the configuration described above, voltage $V_{REF}'$ obtained by division of the output voltage (reference voltage $V_{REF}$) by means of trimming resistors R3, R4 is fed back to inverted input terminal 34 of differential amplifier circuit 32, and such reference voltage $V_{REF}$ which depends upon comparison voltage $V_R$ input to non-inverted input terminal 33 and the resistance ratio between trimming resistors R3, R4 as given by the following expression (1) is output from output transistor 31:

$$V_{REF}=V_R\times(R3+R4)/R4 \quad (1)$$

Since startup circuit 35 raises the output voltage to $(V_R-0.1\ [V])\times(R3+R4)/R4$ when the external power supply is turned on, also raised voltage $V_P$ produced by utilization of reference voltage $V_{REF}$ rises to a certain level. Accordingly, differential amplifier circuit 32 of reference voltage generation circuit 30 operates and raises its output voltage to a predetermined voltage (reference voltage $V_{REF}$).

Startup circuit 35 oscillates upon starting up because it does not have phase compensation capacitor $C_P$. If the output voltage of startup circuit 35 reaches the predetermined voltage, then the voltage fed back to non-inverted input terminal 39 (node D) of differential amplifier circuit 37 becomes substantially equal to comparison voltage $V_R$. Since differential amplifier circuit 37 has an input offset voltage (approximately 0.1 V) through the differentiation in transistor size of transistors Q33, Q34 as described above, the voltage at the output contact (node C) is fluctuated in the positive direction until it becomes substantially equal to external power supply voltage $V_{CC}$, whereupon output transistor 36 is turned off and the oscillation of startup circuit 35 stops completely. Provision of such means for stopping the oscillation eliminates an otherwise possible problem even if startup circuit 35 oscillates when the external power supply is turned on, and consequently, the current to be supplied from constant current source 50 can be reduced.

FIG. 4 is a circuit diagram showing an example of configuration of the comparison voltage generation circuit shown in FIG. 1.

Referring to FIG. 4, comparison voltage generation circuit 40 includes two transistors Q41, Q42 formed from N-channel MOSFETs having threshold voltages different from each other and outputs a voltage difference between threshold voltages $V_t$ of two transistors Q41, Q42 as comparison voltage $V_R$.

In comparison voltage generation circuit 40 having the configuration just described, even if threshold voltages $V_t$ of transistors Q41, Q42 are varied by a variation of the ambient temperature, an otherwise possible variation of comparison voltage $V_R$ can be suppressed if the sizes of transistors Q41, Q42 and the resistance values of resistors R5, R6 are set so as to cancel the voltage variation.

As described above, in startup circuit 35 provided in reference voltage generation circuit 30 shown in FIG. 3, N-channel MOSFETs Q33, Q34 connected to inverted input terminal 38 and non-inverted input terminal 39 of differential amplifier circuit 37, respectively, are formed with different transistor sizes.

This technique utilizes a well-known short channel effect that threshold voltage $V_t$ drops as gate length $L_{poly}$ of a MOSFET decreases. In this instance, two N-channel MOSFETs Q33, Q34 are formed with different gate lengths $L_{poly}$ to set their threshold voltage $V_t$ to different values thereby to provide input offset voltage $V_{OF}$ between non-inverted input terminal 39 and inverted input terminal 38 of differential amplifier circuit 37. More particularly, one of the N-channel MOSFETs is formed with a greater channel length than that of the other N-channel MOSFET to provide a difference of approximately 0.1 to 0.2 V between two threshold voltages $V_t$.

However, in a MOSFET for use with a semiconductor integrated circuit in recent years, further advancement in high integration gives rise to occurrence of such a reverse short channel effect as illustrated in FIG. 5 wherein, as gate length $L_{poly}$, decreases, threshold voltage $V_t$, rises, but as gate length $L_{poly}$ further decreases, threshold voltage $V_t$ drops suddenly.

It is considered that the reverse short channel effect arises from the fact as one of the reasons that, although depending upon the structure of the MOSFET, a point defect is generated by ion implantation into the source-drain region and the point defect and impurity in the proximity of the source-drain region join together and pile up toward the surface of the substrate thereby to increase the impurity density in the proximity of the opposite ends of the channel. Normally, threshold voltage $V_t$ rises as the impurity density of the channel region increases. Accordingly, as the gate length $L_{poly}$ decreases, the ratio of the region of the higher impurity density in the proximity of the channel increases due to the pile-up described above, and this raises threshold voltage $V_t$.

As seen from FIG. 6, although threshold voltage $V_t$ decreases in a region of the $L_{poly}$–$V_t$ characteristic by the reverse short channel effect in which gate length $L_{poly}$ is comparatively large, it does not vary very much. Therefore, in order to assure the difference in threshold voltage $V_t$ of approximately 0.1 V, the transistor sizes must be greatly different. On the contrary, in another region wherein gate length $L_{poly}$ is small, threshold voltage $V_t$ varies suddenly, and a small manufacturing error of gate length $L_{poly}$ appears as a great variation of threshold voltage $V_t$. This does not stabilize the manufacturing process. Further, the reverse short channel effect relies so much upon the manufacturing process conditions that increase of the gate length sometimes does not result in threshold voltage $V_t$.

In short, in a semiconductor integrated circuit in recent years, it has become difficult to set the threshold voltages of two N-channel MOSFETs for use with a differential amplifier circuit for a startup circuit so as to provide a predetermined difference between them by making gate length $L_{poly}$ of the N-channel MOSFETs different from each other. It is to be noted that, if the difference between threshold voltages $V_t$ is set to a low value, then the operation of the differential amplifier circuit becomes so unstable that there is the possibility that it may oscillate even in a steady state. Accordingly, although the difference between threshold voltages $V_t$ need not be set with a high degree of accuracy, it needs to be set at least to a voltage difference (approximately 0. 1 V) with which the differential amplifier circuit does not oscillate.

SUMMARY OF THE INVENTION

It is an object of the present invention to provide a differential amplifier circuit wherein a predetermined input offset voltage can be provided between an inverted input terminal and a non-inverted input terminal with certainty.

In order to attain the object described above, according to the present invention, there is provided a differential amplifier circuit, comprising a first transistor and a second transistor cooperatively forming a current mirror circuit, a third transistor connected in series to the first transistor and connected to an inverted input terminal through which a comparison voltage which is a predetermined constant voltage is input to the third transistor, a fourth transistor connected in series to the second transistor and connected to a non-inverted input terminal through which a feedback voltage which increases in proportion to an output voltage of the third transistor is input to the fourth transistor, a constant current source for supplying-predetermined current to the first, second, third and fourth transistors, and an offset circuit connected in series to the third transistor for providing a predetermined input offset voltage between the inverted input terminal and the non-inverted input terminal.

By forming a differential amplifier circuit having such an offset circuit as described above, an input offset voltage can be provided with certainty between the inverted input terminal and the non-inverted input terminal of the differential amplifier circuit.

Particularly where the differential amplifier circuit of the present invention is applied to a startup circuit for starting up an internal voltage generation circuit when power supply is made available, which does not require setting of the value of an input offset voltage with a high degree of accuracy, even if a MOSFET whose characteristic of the threshold voltage with respect to the gate length is varied by the reverse short channel effect is used to form the differential amplifier circuit, a predetermined input offset voltage can be provided with certainty between the inverted input terminal and the non-inverted input terminal. Accordingly, an internal voltage generation circuit which operates stably can be obtained.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 7:
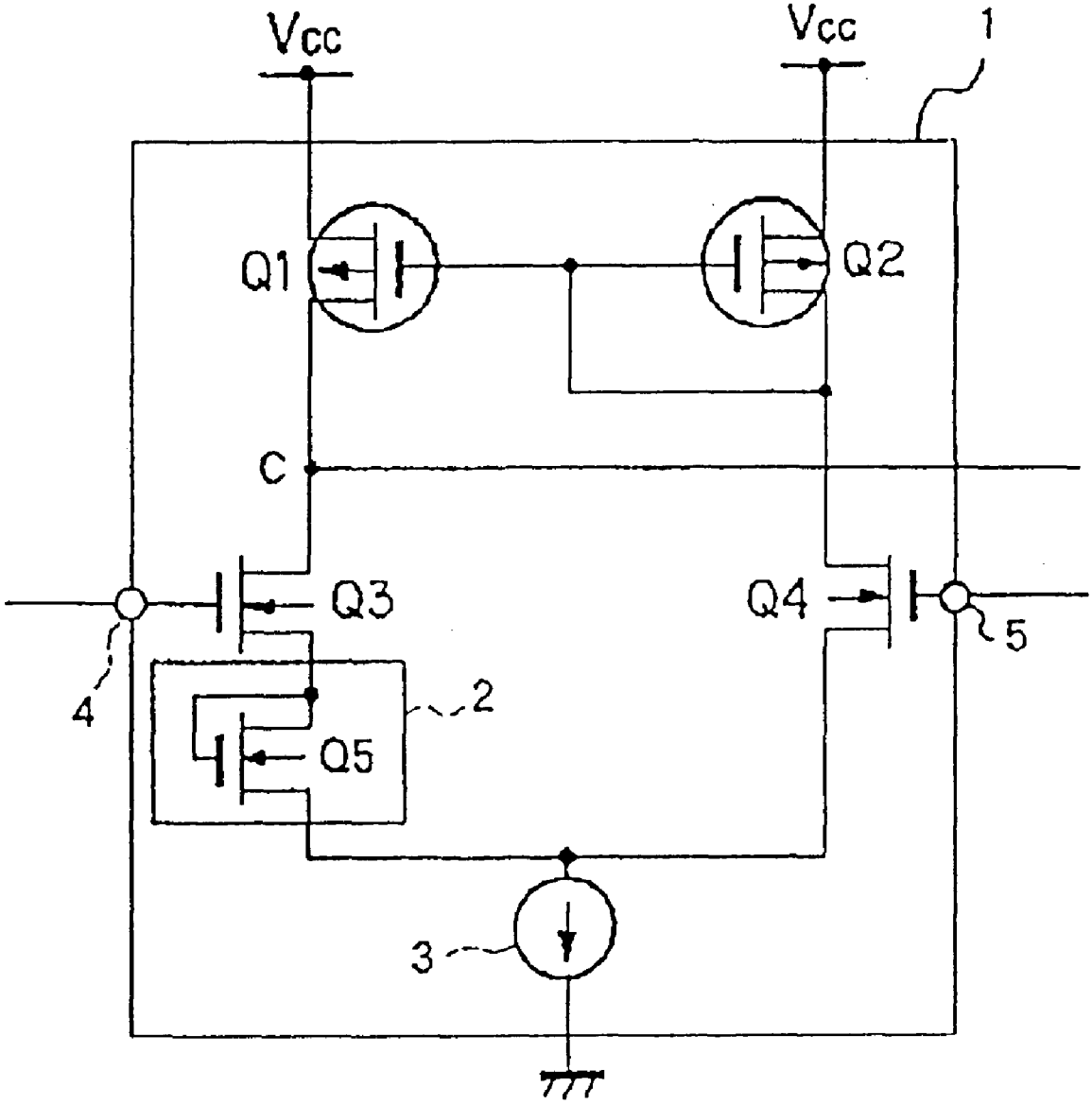
FIG. 7 is a circuit diagram showing an example of configuration of a differential amplifier circuit of the present invention.

Referring to FIG. 7, differential amplifier circuit 1 of the present invention includes transistors Q1, Q2 formed from P-channel MOSFETS connected commonly at the gates thereof, transistor Q3 formed from an N-channel MOSFET connected in series to transistor Q1 and connected at the gate thereof to inverted input terminal 4, transistor Q4 formed from N-channel MOSFET connected in series to transistor Q2 and connected at the gate thereof to non-inverted input terminal 5, offset circuit 2 connected in series to transistor Q3, and constant current source 3 for supplying predetermined current to transistors Q1 to Q5.

Transistors Q1, Q2 form a current mirror circuit by connection of the gate and the drain of transistor Q2 and operates so that the values of current flowing between the source-drain of transistors Q1, Q2 may be equal to each other. It is to be noted that, while, in FIG. 7, the gate and the drain of transistor Q2 are connected to each other, alternatively the gate and the drain of transistor Q1 may be connected to each other.

Offset circuit 2 includes transistor Q5 formed from an N-channel MOSFET and connected in diode-connection as seen in FIG. 7, for example.

Figure 1:
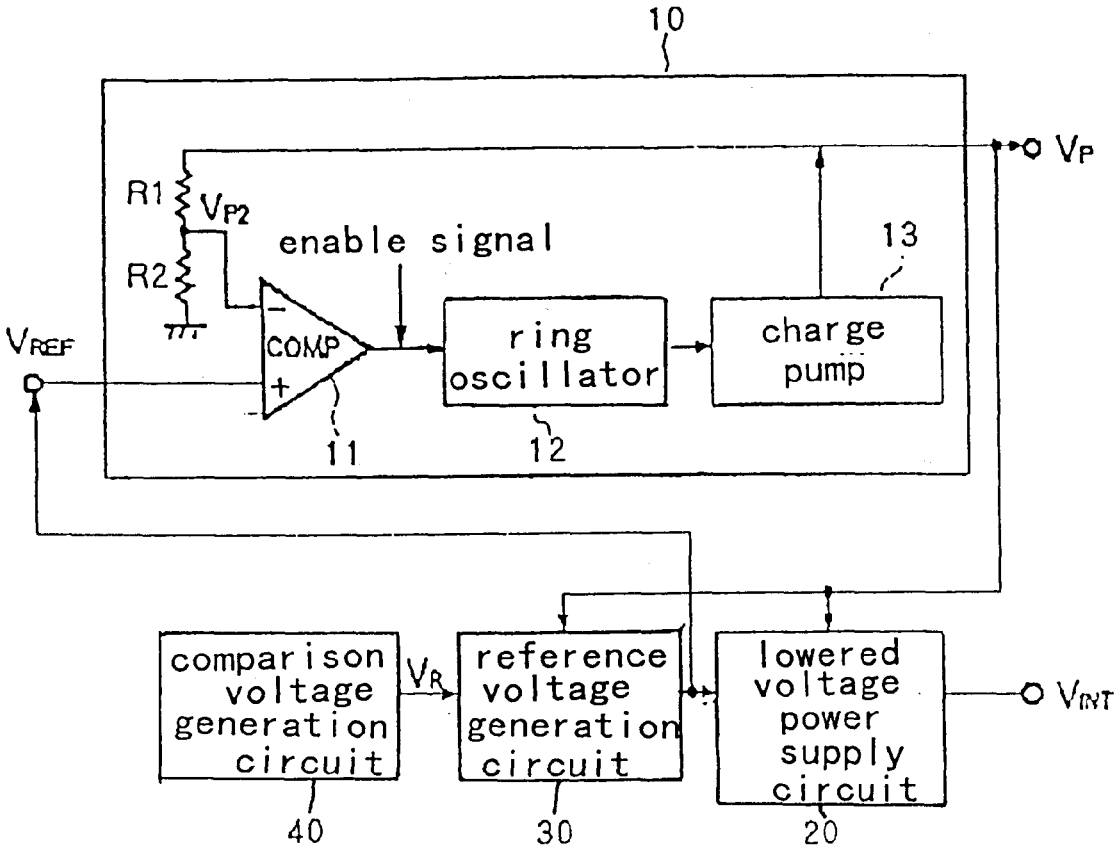
FIG. 1 (PRIOR ART)
FIG. 1 is a block diagram showing an example of configuration of an internal voltage generation circuit.
Figure 2:
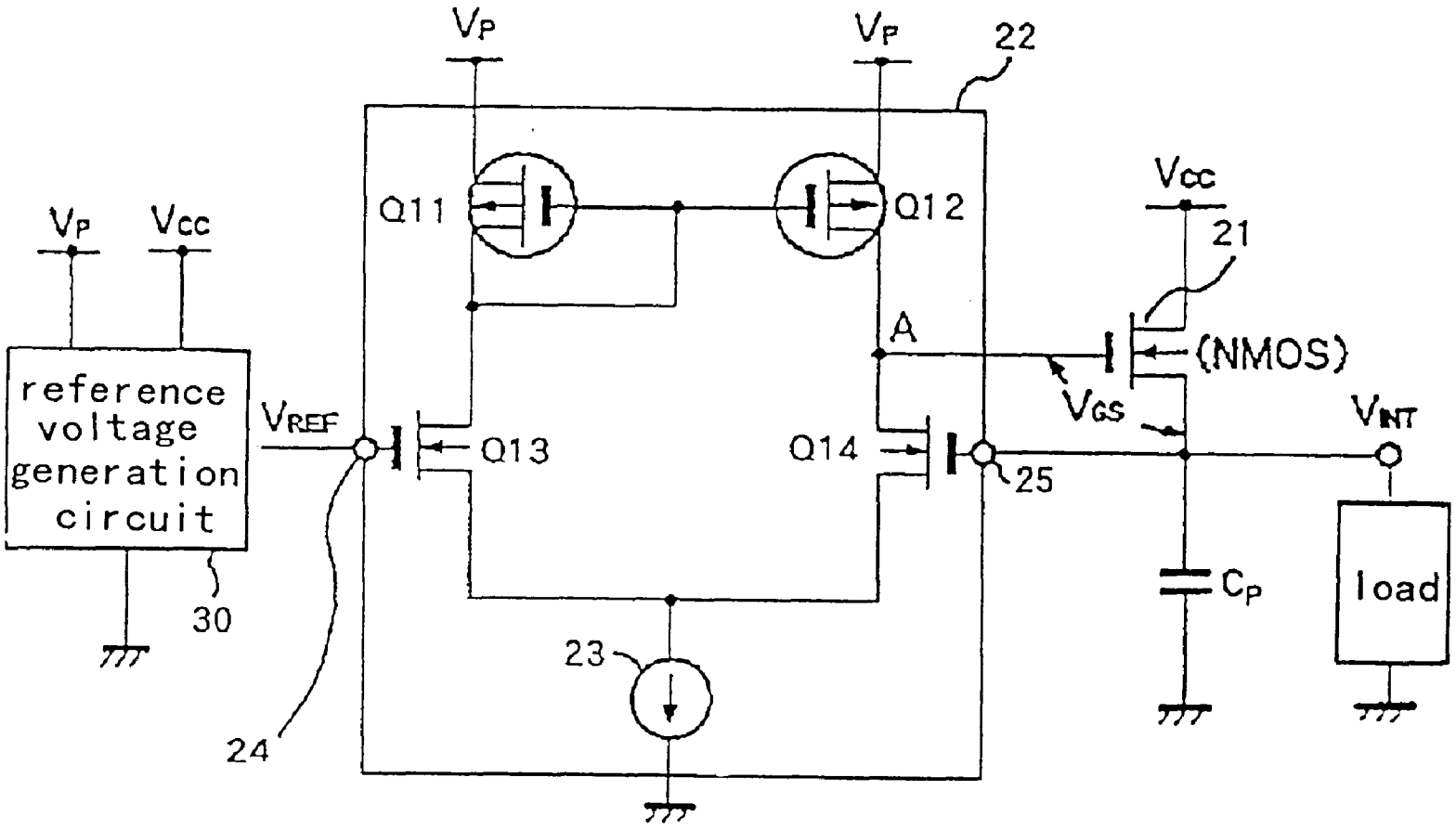
FIG. 2 (PRIOR ART)
FIG. 2 is a circuit diagram showing an example of configuration of a lowered voltage power supply circuit shown in FIG. 1.
Figure 3:
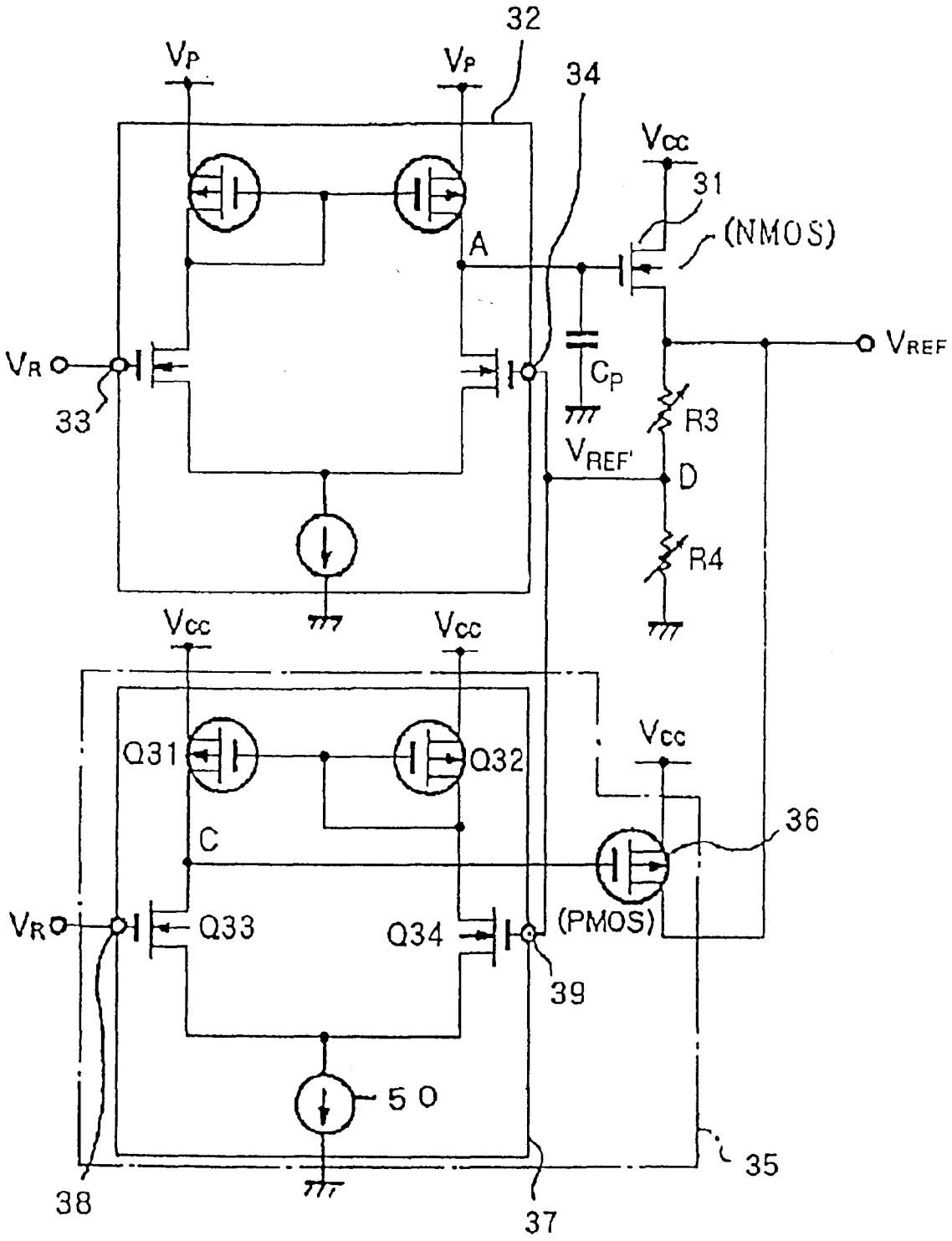
FIG. 3 (PRIOR ART)
FIG. 3 is a circuit diagram showing an example of configuration of a reference voltage generation circuit shown in FIG. 1.
Figure 4:
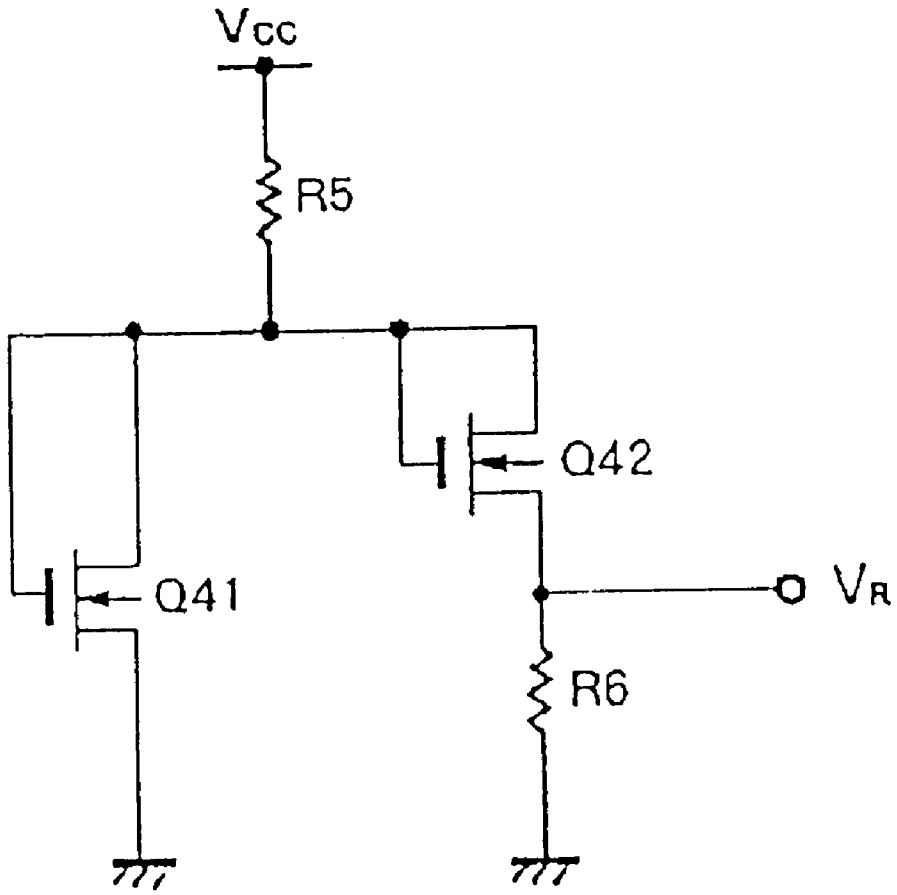
FIG. 4 (PRIOR ART)
FIG. 4 is a circuit diagram showing an example of configuration of a comparison voltage generation circuit shown in FIG. 1.
Figure 5:
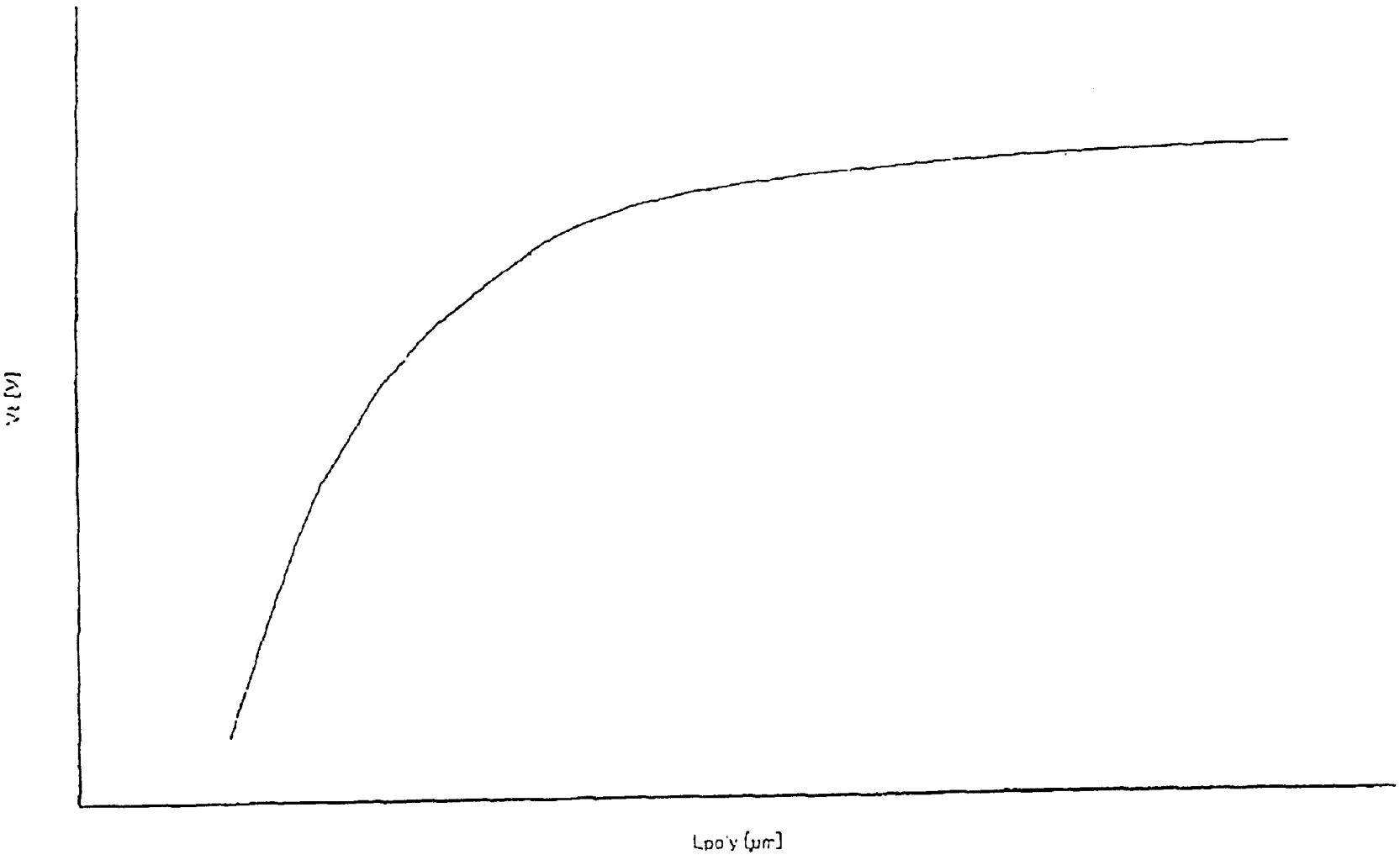
FIG. 5 (PRIOR ART)
FIG. 5 is a graph illustrating an example of characteristic of threshold voltage $V_t$ with respect to gate length $L_{poly}$ by a short channel effect.
Figure 6:
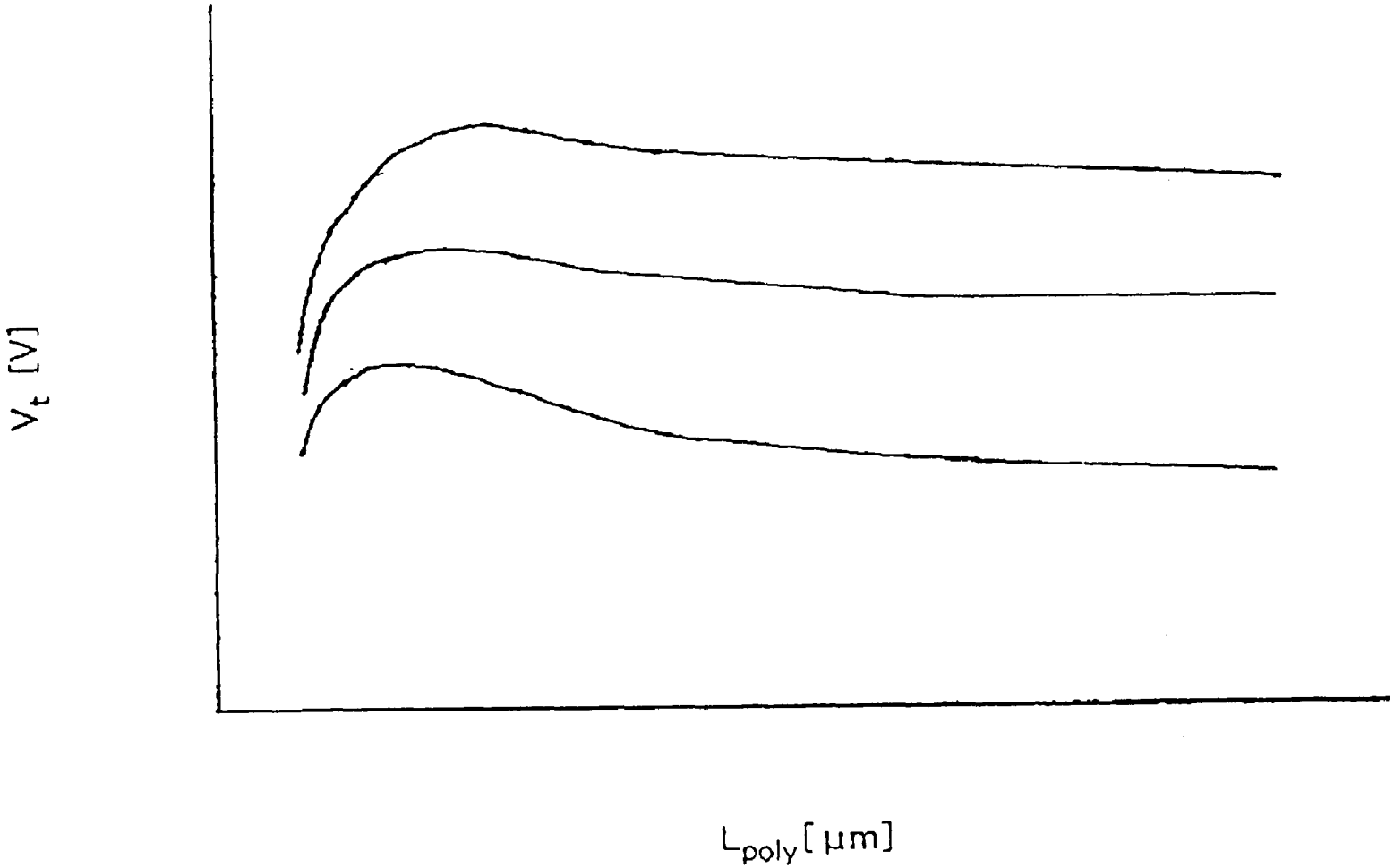
FIG. 6 (PRIOR ART)
FIG. 6 is a graph illustrating an example of characteristic of threshold voltage $V_t$ with respect to gate length $L_{poly}$ by a reverse short channel effect.
Figure 8:
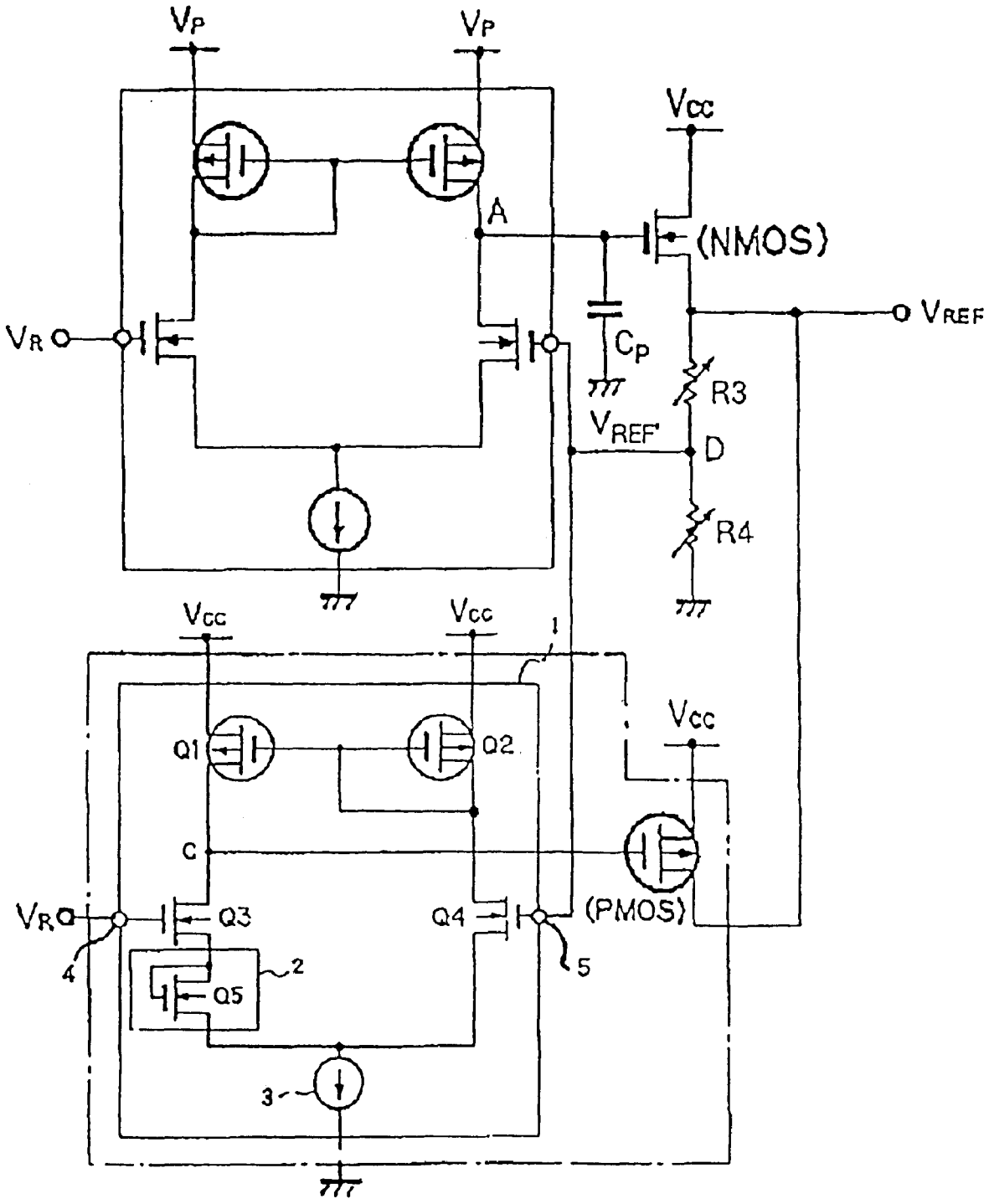
FIG. 8 is a circuit diagram showing an example of application of the differential amplifier circuit shown in FIG. 7.

Differential amplifier circuit 1 of the present invention having the configuration as described above is used as the differential amplifier circuit of the startup circuit shown in FIG. 3, for example. In this instance, as shown in FIG. 8, comparison voltage $V_R$ supplied from a comparison voltage generation circuit is input to the gate of transistor Q3 connected to inverted input terminal 4 of differential amplifier circuit 1, and feedback voltage $V_{REF}'$ which increases in proportion to reference voltage $V_{REF}$ is input to the gate of transistor Q4 connected to non-inverted input terminal 5 of differential amplifier circuit 1. The gate of an output transistor formed from a P-channel MOSFET is connected to node C which is an output of differential amplifier circuit 1, and reference voltage $V_{REF}$ is output from the drain of the output transistor.

Here, differential amplifier circuit 1 of the present invention includes diode-connected transistor Q5 connected in series to transistor Q3 as offset circuit 2. Due to the provision of offset circuit 2 of the configuration just described, input offset voltage $V_{OF}$ substantially equal to threshold voltage $V_t$ of transistor Q5 can be provided between inverted input terminal 4 and non-inverted input terminal 5 of differential amplifier circuit 1.

Accordingly, differential amplifier circuit 1 shown in FIG. 8 operates such that, from the relation of $V_R-V_t(Q5)-V_{REF}'-V_t(Q4)$, $V_{REF}'-V_R-V_t(Q5)$ is satisfied if $V_t(Q3)=V_t(Q4)$.

In other words, differential amplifier circuit 1 operates such that, when feedback voltage $V_{REF}'$ is lower than $V_R-V_t(Q5)$, the potential at node C of differential amplifier circuit 1 drops and source-gate voltage $V_{GS}$ of the output transistor formed from a P-channel MOSFET increases, and consequently, the output voltages (reference voltage $V_{REF}$) rise.

On the other hand, when feedback voltage $V_{REF}'$ is higher than $V_R-V_t(Q5)$, the potential at node C of differential amplifier circuit 1 rises and source-gate voltage $V_{GS}$ of the output transistor decreases, and consequently, the output voltage is lowered by the load.

Where differential amplifier circuit 1 shown in FIG. 7 is incorporated in a startup circuit as seen in FIG. 8, when external power supply voltage $V_{CC}$ is turned on, even if the startup circuit and the reference voltage generation circuit start up and feedback voltage $V_{REF}'$ rises until it exceeds $V_R-V_t(Q5)$, a voltage equal to comparison voltage $V_R$ is supplied to non-inverted input terminal 5 by the reference voltage generation circuit. At this time, since the voltage at node C of differential amplifier circuit 1 rises to a level proximate to external power supply voltage $V_{CC}$, the output transistor is turned off, and the startup circuit stops its operation and ends its role.

Accordingly, if differential amplifier circuit 1 shown in FIG. 7 is used for a startup circuit, then even where an N-channel MOSFET having an $L_{poly}-V_t$ characteristic of the reverse short channel effect is used to form differential amplifier circuit 1, sufficient input offset voltage $V_{OF}$ can be assured between inverted input terminal 4 and non-inverted input terminal 5. Consequently, a reference voltage generation circuit which operates stably can be obtained. Particularly since the value of input offset voltage $V_{OF}$ of a differential amplifier circuit which is used for a startup circuit need not be set with a high degree of accuracy, the differential amplifier circuit of the present invention can be applied suitably to such a circuit as a startup circuit.

It is to be noted that, while offset circuit 2 shown in FIG. 7 is configured so that it includes transistor Q5 formed from a diode-connected N-channel MOSFET, offset circuit 2 is not limited to the specific circuit.

Figure 9A:
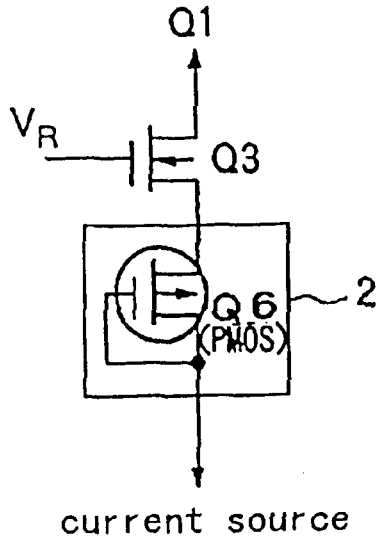
FIGS. 9A and 9B are circuit diagrams showing other examples of configuration of an offset circuit shown in FIG. 7.
Figure 9B:
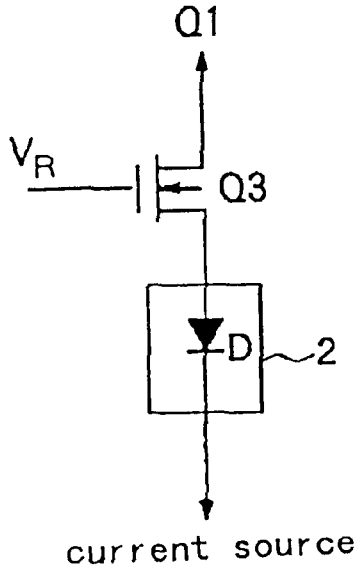

Offset circuit 2 may be configured such that it includes transistor Q6 formed from a diode-connected P-channel MOSFET as shown in FIG. 9A, for example, or offset circuit 2 may be configured such that it includes diode D connected in series to transistor Q3 as shown in FIG. 9B. A Schottky diode may be used for diode D shown in FIG. 9B.

Usually, in order to lay a wire to a transistor or a diode formed on a substrate, a contact for joining metal (W (tungsten), for example) and an impurity region (source, drain anode, cathode or the like) to each other is formed, and P (phosphorus) or a like material is implanted into the contact to raise the impurity density thereby to form ohmic contact between the metal and the contact.

Accordingly, a Schottky diode having a rectification characteristic can be formed by joining metal directly to an impurity region without adjusting the impurity density. In other words, a Schottky diode can be formed without adding a new step to a process for forming a CMOSFET. It is to be noted that, where an ordinary diode is used for offset circuit 2, 0.4 to 0.5 V of input offset voltage $V_{OF}$ is obtained, but where a Schottky diode is used, 0.1 to 0.2 V of input offset voltage $V_{OF}$ is obtained.

Figure 10A:
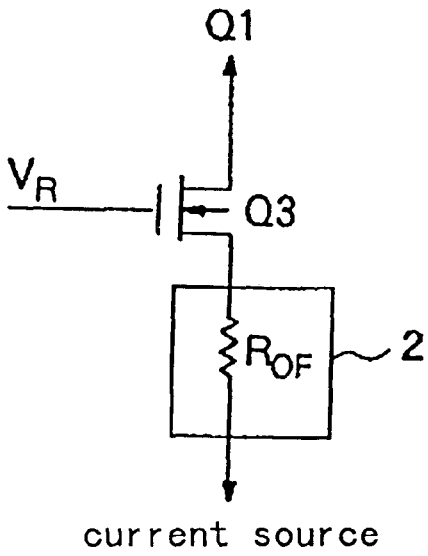
FIGS. 10A and 10B are circuit diagrams showing other examples of configuration of the offset circuit shown in FIG. 7.
Figure 10B:
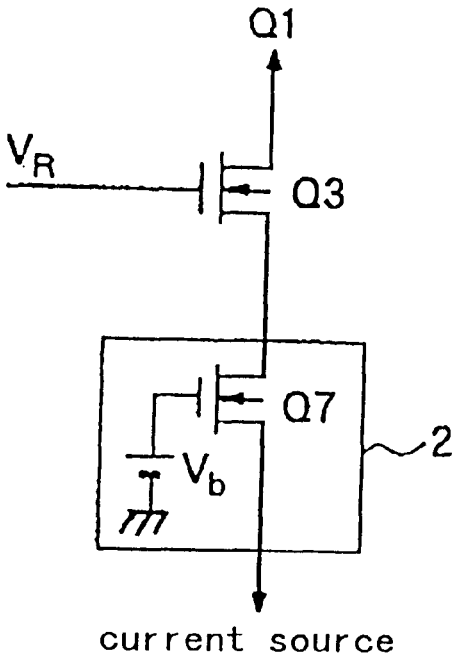

As an alternative, offset circuit 2 may include resistor $R_{OF}$ connected in series to transistor Q3 as seen in FIG. 10A, or as an example for realizing resistor $R_{OF}$, offset circuit 2 may include transistor Q7 formed from an N-channel MOSFET or a P-channel MOSFET (N-channel MOSFET is shown as an example in FIG. 10B) to whose gate predetermined bias voltage $V_b$ is applied as seen in FIG. 10B. In this instance, if the current to be supplied to constant current source 3 is 0.4 $\mu$A, for example, then if resistor $R_{OF}$ inserted has a resistance value of 1 MΩ, then input offset voltage $V_{OF}$ is 0.23 V, but if resistor $R_{OF}$ has another resistance value of 2 MΩ, then input offset voltage $V_{OF}$ is 0.45 V.

While preferred embodiments of the present invention have been described using specific terms, such description is for illustrative purposes only, and it is to be understood that changes and variations may be made without departing from the spirit or scope of the following claims.

What is claimed is:

1. A differential amplifier circuit, comprising:

a first transistor and a second transistor cooperatively forming a current mirror circuit;

a third transistor connected in series to said first transistor and connected to an inverted input terminal through which a comparison voltage which is a predetermined constant voltage is input to said third transistor;

a fourth transistor connected in series to said second transistor and connected to a non-inverted input terminal through which a feedback voltage which increases in proportion to an output voltage of said third transistor is input to said fourth transistor;

a constant current source for supplying predetermined current to said first, second, third and fourth transistors; and an offset circuit connected in series to said third transistor for providing a predetermined input offset voltage between said inverted input terminal and said non-inverted input terminal.

2. The differential amplifier circuit according to claim 1, wherein said differential amplifier circuit is used in a startup circuit for starting up a reference voltage generation circuit, which operates with a predetermined external power supply voltage supplied from the outside and supplies a predetermined reference voltage to a raised voltage power supply circuit for producing a raised voltage higher than the external power supply voltage, when the external power supply voltage is made available.

3. The differential amplifier circuit according to claim 1, wherein said third and fourth transistors have a threshold voltage characteristic which varies with respect to the gate length due to a reverse short channel effect.

4. The differential amplifier circuit according to claim 1, wherein said offset circuit includes a diode-connected N-channel MOSFET.

5. The differential amplifier circuit according to claim 1, wherein said offset circuit includes a diode-connected P-channel MOSFET.

6. The differential amplifier circuit according to claim 1, wherein said offset circuit includes a diode connected in series to said third transistor.

7. The differential amplifier circuit according to claim 6, wherein said diode is a Schottky diode.

8. The differential amplifier circuit according to claim 1, wherein said offset circuit includes a resistor connected in series to said third transistor.

9. The differential amplifier circuit according to claim 8, wherein said resistor is a MOSFET to which a predetermined bias voltage is input.

* * * * *